US005228633A

United States Patent [19]

Johnson et al.

[11] Patent Number: 5,228,633

[45] Date of Patent: Jul. 20, 1993

[54] PAPER ROLL HOLDER AND METHOD

[75] Inventors: Robert A. Johnson, Seguin; Edward L. Saxton, Buda, both of Tex.

[73] Assignee: Motorola, Inc., Schaumburg, Ill.

[21] Appl. No.: 830,087

[22] Filed: Feb. 3, 1992

[51] Int. Cl.[5] ..... B65H 16/06

[52] U.S. Cl. ..... 242/55.53; 242/55.2

[58] Field of Search ..... 242/55.53, 55.2, 55.3

[56] References Cited

U.S. PATENT DOCUMENTS

| | | | |
|---|---|---|---|
| 790,998 | 5/1905 | Barker | 242/55.53 |
| 2,095,419 | 10/1937 | Pollard | 242/55.53 |
| 2,905,404 | 9/1959 | Simmons | 242/55.2 |
| 2,978,197 | 4/1961 | Anderson | 242/55.2 |
| 4,228,443 | 10/1980 | Williams | 346/165 |
| 4,614,312 | 9/1986 | Del Pino | 242/55.2 |
| 4,977,432 | 12/1990 | Coombs et al. | 355/309 |

*Primary Examiner*—William A. Cuchlinski, Jr.

*Assistant Examiner*—C. W. Fulton

*Attorney, Agent, or Firm*—Jeffrey D. Nehr

[57] ABSTRACT

A method and apparatus for the holding of paper rolls in printing devices, e.g., facsimile machines, which includes a housing for accommodating the paper roll, the housing comprising parallel and substantially flat first and second housing endplates along a longitudinal axis; first and second paper roll supports adapted to fit first and second ends of the paper roll, respectively, the first and second paper roll supports flexibly coupled to the first and second housing endplates; and first and second springs for pressing the first and second paper roll supports against the first and second ends of the paper roll, respectively, to compressively hold the paper roll when the paper roll is inserted in the holder, the first spring coupled between the first housing endplate and the first paper roll support, and the second spring coupled between the second housing endplate and the second paper roll support.

11 Claims, 2 Drawing Sheets

FIG. 2
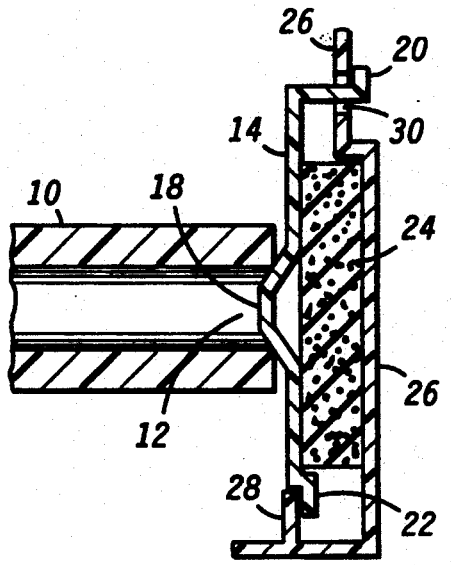
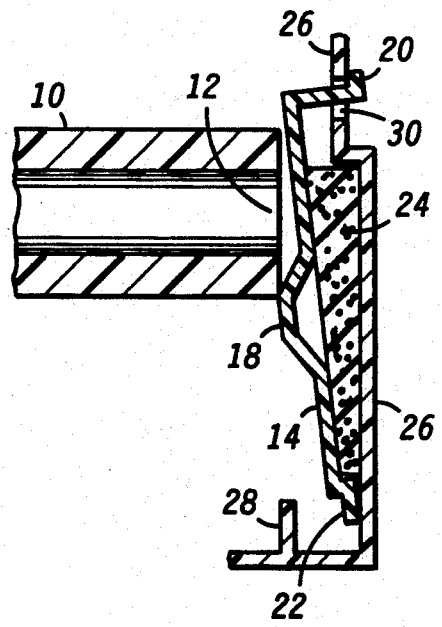
FIG. 3
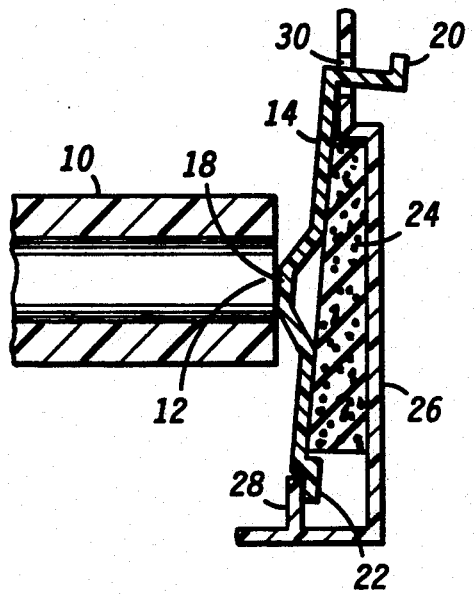
FIG. 4

PAPER ROLL HOLDER AND METHOD

FIELD OF THE INVENTION

This invention relates in general to the field of paper roll holders, and in particular to paper roll holders and methods for paper roll holding in facsimile machines.

BACKGROUND OF THE INVENTION

Paper roll holders and methods for paper roll holding are important in a number of devices, including facsimile machines, copiers, calculators, and printers. To help competitively produce such devices with high quality, there is a need to produce a simple paper roll holder with a lesser number of parts, using a design that provides low cost and ease in assembly of the paper roll holder.

Traditional apparatus and methods for holding paper rolls often involve a relatively large number of parts, some of which are removable, and may involve the use of compression springs and guide pin holders. Loose parts are disadvantageous because they may be lost by customers, users, or servicers of the machine containing the paper holder. Guide pin rollers or intricate springs represent unnecessary complication in assembly and maintenance, as well as increased part count and cost.

The development of a new facsimile machine provided an impetus to meet the need for securing a paper roll in a low-cost, straightforward manner. The need existed to use only a few simple, yet reliable, parts in the design. The need also existed to devise a method which would allow for easy assembly of the holder which would securely hold the paper roll and yet allow paper to be easily dispensed from the paper roll.

SUMMARY OF THE INVENTION

Accordingly, it is an advantage of the present invention to provide a new and improved method and apparatus for the holding of paper rolls. It is a further advantage of the present invention to provide a method and apparatus for the holding of paper rolls which involves relatively few parts which do not require removal from the holder when replacing paper rolls in the paper roll holder. It is also an advantage of the present invention to provide an apparatus for the holding of paper rolls which is easy to assemble.

To achieve these advantages, an apparatus for the holding of paper rolls is contemplated which includes a housing for accommodating the paper roll along a longitudinal axis of the housing, the housing comprising substantially flat first and second housing endplates perpendicular to the longitudinal axis at first and second ends of the housing along the longitudinal axis; first and second paper roll supports adapted to hold the first and second paper roll ends, respectively, the first and second paper roll supports held parallel to the first and second housing endplates; and, first and second springs for pressing the first and second paper roll supports against the first and second paper roll ends to compressively hold the paper roll when the paper roll is inserted in the holder, the first spring positioned between the first housing endplate and the first paper roll support, and the second spring positioned between the second housing endplate and the second paper roll support.

Furthermore, the method for the holding of paper rolls comprises the steps of providing a housing comprising substantially flat first and second housing endplates; placing first and second springs adjacent to the first and second housing endplates, respectively; and, coupling first and second paper roll supports to the first and second housing endplates, respectively, so that the first spring is partially compressed between the first housing endplate and the first paper roll support and the second spring is partially compressed between the second housing endplate and the second paper roll support, the first and second springs capable of additional compression to accommodate insertion of the paper roll between the first and second paper roll supports.

The above and other features and advantages of the present invention will be better understood from the following detailed description taken in conjunction with the accompanying drawings.

BRIEF DESCRIPTION OF THE DRAWINGS

In FIG. 2, there is shown a cross-sectional view of the right-hand end of the assembled paper roll holder with a paper roll inserted in the holder.

In FIG. 3, there is shown a cross-sectional view of the right-hand end of the assembled paper roll as in FIG. 2, illustrating insertion of a paper roll into the holder.

In FIG. 4, there is shown a cross-sectional view of the right-hand end of the assembled paper roll as in FIG. 2, illustrating removal of a paper roll from the holder.

DETAILED DESCRIPTION OF THE PREFERRED EMBODIMENT

Figure 1:
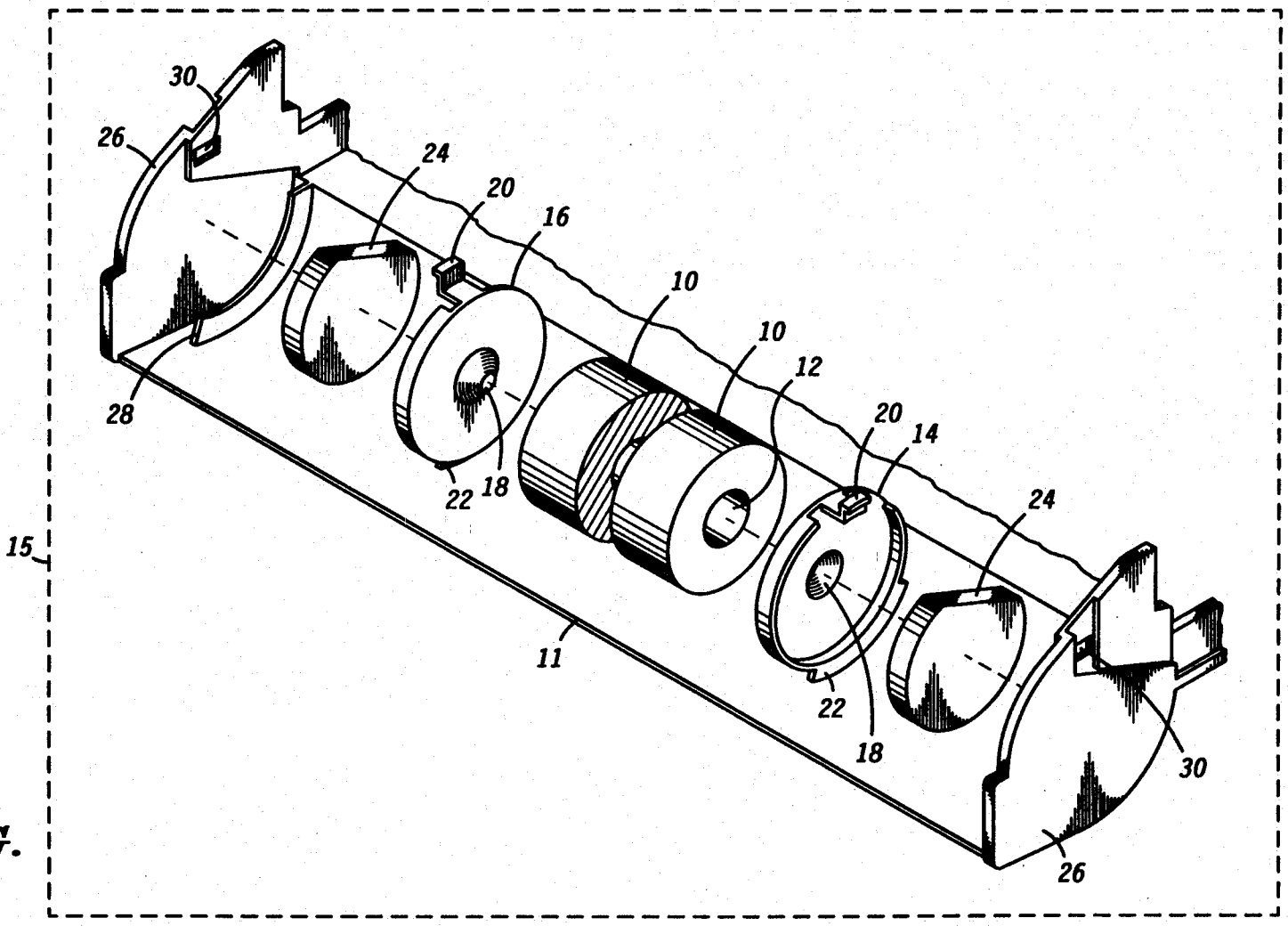
In FIG. 1, there is shown an exploded view of a paper roll holder in accordance with a preferred embodiment of the invention.

FIG. 1 illustrates an exploded view of a paper roll holder in accordance with a preferred embodiment of the invention. The paper roll holder is shown schematically within a machine 15 which uses a paper roll holder, such as a facsimile machine, copier, calculator, copier, or other printing device. The paper roll holder accommodates paper roll 10 which is shown in FIG. 1 with the center section of the paper roll 10 removed. Paper roll 10 comprises a cylindrical roll of paper about a tube with tube ends 12 (only the right tube end 12 shown in FIG. 1).

The paper roll holder comprises paper roll housing 11, springs 24, right-hand paper roll support 14, and left-hand paper roll support 16. The paper roll housing 11 includes substantially flat endplates 26. Adjacent to each of the endplates 26, in the direction of the center of the paper roll housing, are paper roll housing keeper ribs 28 (only the left-hand side keeper rib 28 is shown in FIG. 1) which are important in holding the paper roll supports 14 and 16 in proper position in the assembled paper roll holder, as described below. The right-hand and left-hand ends of the paper roll holder are symmetric with one another.

Each of the paper roll housing keepers 28 are spaced inwardly toward the center of housing 11 a short distance away from the endplates 26. The spacing of the paper roll housing keepers 28 from the endplates 26 is to accommodate either the right-hand paper roll support 14 or left-hand paper roll support 16, depending on the end of the paper roll holder in question.

Both the right-hand paper roll support 14 and the left-hand paper roll support 16 comprise a hub 18, a paper roll support keeper rib 22, and a paper roll support hook 20. Since each end of the paper roll holder is symmetric, the following explanation discusses coupling and function of the left-hand paper roll support 16 and the paper roll housing 11 only. The coupling and function of the right-hand paper roll support 14 relative to the paper roll housing 11 is in the same manner, except in a right-hand sense.

FIG. 1 illustrates how the paper roll housing 11 is assembled, and how the paper roll 10 is accommodated by the paper roll supports 14 and 16. The paper roll support keeper rib 22 on the left-hand paper roll support 16 is placed between the paper roll housing keeper rib 28 and the paper roll housing endplate 26 on the left-hand side of housing 11. Spring 24 is placed between left-hand paper roll support 16 and the paper roll housing endplate 26 on the left-hand side of paper roll housing 11. The paper roll support 16 can then be positioned so that paper roll support hook 20 can be flexed and inserted through slot 30 in the paper roll housing endplate 26. The thickness of spring 24 is such that spring 24 is partially compressed when paper roll support 16 is restrained in position by paper roll housing keeper rib 28 and paper roll support hook 20.

Paper roll support hook 20, paper roll support keeper rib 22, and paper roll support hub 18 can be fashioned separately and subsequently attached to the paper roll support 16, or they can be an integral component of paper roll support 16 (e.g., of one piece of molded plastic such as in the preferred embodiment discussed here).

Springs 24 in the preferred embodiment are comprised of elastomeric foam, such as that available from Rogers Corporation in Connecticut. The polyester urethane is 6 # density and is approximately one-quarter inch thick in the preferred embodiment. The foam exhibits a 4 to 8 pound per square inch compression pressure for deflection. Pressure sensitive adhesive with a peel-off liner is used in the preferred embodiment to affix springs 24 to endplates 26. Either of springs 24 can also comprise coil springs or other spring mechanisms.

When both paper roll supports 14 and 16 are properly coupled to paper roll housing 11, compressing springs 24 against paper roll housing endplates 26, the paper roll 10 can be inserted into the paper roll holder. The distance between the paper roll supports 14 and 16, not including the height of hubs 18, is sufficient to accommodate the length of paper roll 10.

FIG. 2 illustrates via cross-sectional view how the paper roll tube end 12 is held by the paper roll support hub 18 on the right-hand side of the mounted paper roll 10. Paper roll support hub 18 is a tapered hub such that at least a portion paper roll support hub 18 can be inserted into paper roll tube end 12 when paper roll 10 is held by the paper roll holder.

FIG. 2 also shows right-hand paper roll support 14 compressing spring 24 against paper roll housing endplate 26. Paper roll support 14 is held in place by paper roll support keeper rib 22 restrained by paper roll housing keeper rib 28 and by paper roll support hook 20 positioned through slot 30 and held in place by housing endplate 26.

In FIG. 3, there is again shown a cross-sectional view of the right-hand side of the assembled paper roll holder as in FIG. 2. However, FIG. 3 illustrates insertion of a paper roll 10 into the paper roll holder.

As shown in FIG. 3, the insertion of paper roll 10 into the paper roll holder on the right-hand side of the paper roll holder exerts a force on hub 18 of paper roll support 14. Paper roll support 14, in response to the introduction of paper roll 10, additionally compresses spring 24, with more compression occurring in the portion of the spring 24 closest to paper roll support keeper rib 22 and less compression occurring in the portion of the spring 24 closest to paper roll support hook 20. Paper roll support hook 20 acts as a pivot for the additional compression of spring 24, as shown in FIG. 3.

When spring 24 has compressed sufficiently to allow the end of the paper roll tube 12 to fit over the hub 18 of paper roll support 14, spring 24 reexpands to hold the right end of the paper roll in compression against the similarly restrained hub 18 of the left-hand paper roll support 16.

In FIG. 4, there is again shown a cross-sectional view of the right-hand side of the assembled paper roll holder as in FIG. 2. However, FIG. 4 illustrates removal of a paper roll 10 from the paper roll holder.

As shown in FIG. 4, the removal of paper roll 10 from the paper roll holder exerts a force on hub 18 of paper roll support 14. Paper roll support 14, in response to the removal of paper roll 10, additionally compresses spring 24, with less compression occurring in the portion of the spring 24 closest to paper roll support keeper rib 22 and more compression occurring in the portion of the spring 24 closest to paper roll support hook 20. Paper roll support keeper rib 22 acts as a pivot for the additional compression of spring 24, as shown in FIG. 4.

When spring 24 has compressed sufficiently to allow the end of the paper roll tube 12 to be removed from the hub 18 of paper roll support 14, spring 24 re-expands and paper roll support 14 returns to its restrained position, with paper roll support 14 pressed by spring 24 against paper roll housing keeper rib 28 and, through paper roll support hook 20, restrained against endplate 26.

Thus, there has been described a method and apparatus for the holding of paper rolls which overcomes specific problems and accomplishes certain advantages relative to prior art methods and mechanisms. The improvements are significant. The method and apparatus provides for relatively few number of parts, none of which comprise loose parts that may be lost by customers or users or servicers of the machine. A lesser part count also reduces the cost to produce the paper roll holder. Guide pin rollers or intricate springs represent unnecessary complication and are not used. The method and apparatus contemplated allow for easy assembly, and the paper roll holder securely holds a paper roll while simultaneously allowing paper to be easily dispensed from the roll. The method and apparatus are adaptable to paper rolls of varying size in various machines including calculators, printers, copying machines, facsimile machines, and other machines requiring paper rolls.

Thus, there has also been provided, in accordance with an embodiment of the invention, a method and apparatus for the holding of paper rolls which overcomes specific problems and accomplishes certain advantages and which fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

What is claimed is:

1. A holder for a paper roll including first and second paper roll ends, the holder comprising:

a housing for accommodating the paper roll along a longitudinal axis of the housing, the housing comprising substantially flat first and second housing endplates perpendicular to the longitudinal axis at first and second ends of the housing along the longitudinal axis, and the housing further comprising first and second paper roll support restraining means;

first and second paper roll supports adapted to hold the first and second paper roll ends, respectively, the first and second paper roll supports held parallel to the first and second housing endplates by the first and the second paper roll support restraining means, respectively;

first and second spring means for pressing the first and the second paper roll supports against the first and second paper roll ends, respectively, to compressively hold the paper roll when the paper roll is inserted in the holder, the first spring means positioned between the first housing endplate and the first paper roll support, and the second spring means positioned between the second housing endplate and the second paper roll support; and the first paper roll support restraining means comprising:

a first housing keeper rib attached to the housing, the first housing keeper rib located adjacent to the first housing endplate for receiving a portion of the first paper roll support between the first housing endplate and the first housing keeper rib; and a first slot in the housing, the first slot for receiving and coupling to the first paper roll support.

2. A holder as claimed in claim 1, wherein the second paper roll support restraining means comprises:

a second housing keeper rib coupled to the housing, the second housing keeper rib located adjacent to the second housing endplate for receiving a portion of the second paper roll support between the second housing endplate and the second housing keeper rib; and a second slot in the housing, the second slot for receiving and coupling to the second paper roll support.

3. A holder as claimed in claim 2, wherein the second paper roll support comprises:

a substantially flat second disk;

a second hub coupled to and extending substantially perpendicularly from the second disk, the second hub for engaging the second end of the paper roll;

a second hook coupled to and extending substantially perpendicularly from the second disk in a direction opposite that of the second hub, the second hook for engaging and coupling to the second slot in the housing;

a second paper roll support keeper rib connected to an edge of the second paper roll support, the second paper roll support keeper rib extending perpendicularly from the second disk in a direction opposite that of the second hub and extending in the same direction as the second hook, the second paper roll support keeper rib comprising the portion of the second paper roll support to be received between the second housing endplate and the second housing keeper rib.

4. A holder as claimed in claim 1, wherein the first paper roll support comprises:

a substantially flat first disk;

a first hub coupled to and extending substantially perpendicularly from the first disk, the first hub for engaging the first end of the paper roll;

a first hook coupled to and extending substantially perpendicularly from the first disk in a direction opposite that of the first hub, the first hook for engaging and coupling to the first slot in the housing;

a first paper roll support keeper rib connected to an edge of the first paper roll support, the first paper roll support keeper rib extending perpendicularly from the first disk in a direction opposite that of the first hub and extending in the same direction as the first hook, the first paper roll support keeper rib comprising the portion of the first paper roll support to be received between the first housing endplate and the first housing keeper rib.

5. In a facsimile (fax) machine, a paper roll holder for a paper roll including first and second paper roll ends, the holder comprising:

a housing for accommodating the paper roll along a longitudinal axis of the housing, the housing comprising substantially flat first and second housing endplates perpendicular to the longitudinal axis at first and second ends of the housing along the longitudinal axis, the housing further comprising first and second paper roll support restraining means to flexibly hold a first paper roll support to the first housing endplate and a second paper roll support to the second housing endplate, respectively, with the first paper roll support restraining means comprising:

a first housing keeper rib coupled to the housing, the first housing keeper rib located adjacent to the first housing endplate for receiving a portion of the first paper roll support between the first housing endplate and the first housing keeper rib; and a first slot in the housing, the first slot for receiving and coupling to the first paper roll support;

the first and the second paper roll supports adapted to hold the first and second paper roll ends, respectively, parallel to the first and second housing endplates; and first and second spring means for pressing the first and the second paper roll supports against the first and the second paper roll ends to compressively hold the paper roll when the paper roll is inserted in the holder, the first spring means positioned between the first housing endplate and the first paper roll support, and the second spring means positioned between the second housing endplate and the second paper roll support.

6. A holder as claimed in claim 5, wherein the housing comprises second paper roll support restraining means to flexibly hold the second paper roll support in contact with the second housing endplate, the second paper roll support restraining means comprising:

a second housing keeper rib coupled to the housing, the second housing keeper rib located adjacent to the second housing endplate for receiving a portion of the second paper roll support between the second housing endplate and the second housing keeper rib; and a second slot in the housing, the second slot for receiving and coupling to the second paper roll support.

7. A holder as claimed in claim 6, wherein the second paper roll support comprises:

a substantially flat second disk;

a second hub coupled to and extending substantially perpendicularly from the second disk, the second hub for engaging the second end of the paper roll;

a second hook coupled to and extending substantially perpendicularly from the second disk in a direction opposite that of the second hub, the second hook for engaging and coupling to the second slot in the housing;

a second paper roll support keeper rib connected to an edge of the second paper roll support, the second paper roll support keeper rib extending perpendicularly from the second disk in a direction opposite that of the second hub and extending in the same direction as the second hook, the second paper roll support keeper rib comprising the portion of the second paper roll support to be received between the second housing endplate and the second housing keeper rib.

8. A holder as claimed in claim 5, wherein the first paper roll support comprises:

a substantially flat first disk;

a first hub coupled to and extending substantially perpendicularly from the first disk, the first hub for engaging the first end of the paper roll;

a first hook coupled to and extending substantially perpendicularly from the first disk in a direction opposite that of the first hub, the first hook for engaging and coupling to the first slot in the housing;

a first paper roll support keeper rib connected to an edge of the first paper roll support, the first paper roll support keeper rib extending perpendicularly from the first disk in a direction opposite that of the first hub and extending in the same direction as the first hook, the first paper roll support keeper rib comprising the portion of the first paper roll support to be received between the first housing endplate and the first housing keeper rib.

9. A method for assembling a holder for securing a paper roll, the method comprising the steps of:

providing a housing comprising substantially flat and parallel first and second housing endplates;

placing first and second springs adjacent to and against the first and second housing endplates, respectively, the first and second springs facing each other;

placing a portion of a first paper roll support between the housing endplate and a first housing keeper rib;

placing a portion of a second paper roll support between the second housing endplate and a second housing keeper rib;

coupling a first hook extending perpendicularly from the first paper roll support through a first slot in the housing, wherein the first housing keeper rib and the first hook secure the first paper roll support to the first housing endplate and the first spring is partially compressed between the first housing endplate and the first paper roll support;

coupling a second hook extending perpendicularly from the second paper roll support through a second slot in the housing, wherein the second housing keeper rib and the second hook secure the second paper roll support to the second housing endplate and the second spring is partially compressed between the second housing endplate and the second paper roll support such that the first and the second springs are capable of additional compression to accommodate insertion of the paper roll between the first and second paper roll supports.

10. In a printing device, a holder for a paper roll including first and second paper roll ends, the holder comprising:

a housing for accommodating the paper roll along a longitudinal axis of the housing, the housing comprising substantially flat first and second housing endplates perpendicular to the longitudinal axis at first and second ends of the housing along the longitudinal axis and further comprising first paper roll support restraining means to flexibly hold a first paper roll support to the first housing endplate, the first paper roll support restraining means comprising:

a first housing keeper rib attached to the housing, the first housing keeper rib located adjacent to the first housing endplate for receiving a portion of the first paper roll support between the first housing endplate and the first housing keeper rib; and a first slot in the housing, the first slot for receiving and coupling to the first paper roll support;

the first paper roll support and a second paper roll support adapted to hold the first and second paper roll ends, respectively, with the first and second paper roll supports held parallel to the first and second housing endplates; and first and second spring means for pressing the first and second paper roll supports against the first and second paper roll ends to compressively hold the paper roll when the paper roll is inserted in the holder, the first spring means positioned between the first housing endplate and the first paper roll support, and the second spring means positioned between the second housing endplate and the second paper roll support.

11. A holder as claimed in claim 10, wherein the first paper roll support comprises:

a substantially flat first disk;

a first hub coupled to and extending substantially perpendicularly from the first disk, the first hub for engaging the first end of the paper roll;

a first hook coupled to and extending substantially perpendicularly from the first disk in a direction opposite that of the first hub, the first hook for engaging and coupling to the first slot in the housing;

a first paper roll support keeper rib connected to an edge of the first paper roll support, the first paper roll support keeper rib extending perpendicularly from the first disk in a direction opposite that of the first hub and extending in the same direction as the first hook, the first paper roll support keeper rib comprising the portion of the first paper roll support to be received between the first housing endplate and the first housing keeper rib.

* * * * *